US005660386A

United States Patent [19]

Krieger

[11] Patent Number: 5,660,386

[45] Date of Patent: Aug. 26, 1997

[54] BALL THROWING APPARATUS AND METHOD

[76] Inventor: George Krieger, 1103-A S. 43rd Ave., Yakima, Wash. 98908

[21] Appl. No.: 657,648

[22] Filed: May 28, 1996

[51] Int. Cl.[6] ..... A63B 69/40

[52] U.S. Cl. ..... 124/7

[58] Field of Search ..... 273/26 D, 29 A; 124/4, 7, 8, 16, 17, 20.1

[56] References Cited

U.S. PATENT DOCUMENTS

| | | | |
|---|---|---|---|
| 943,494 | 12/1909 | Venn | 124/7 |
| 1,162,910 | 12/1915 | Goude | 124/7 |
| 2,080,958 | 5/1937 | Beasley et al. | 273/26 |
| 3,262,439 | 7/1966 | Johns | 124/7 |
| 3,406,674 | 10/1968 | Zone | 124/7 |
| 3,517,656 | 6/1970 | Darrell | 124/7 |
| 3,552,371 | 1/1971 | Kahelin | 124/7 |
| 3,722,494 | 3/1973 | Slevin | 124/7 |
| 3,892,217 | 7/1975 | Raty | 124/7 |
| 4,082,076 | 4/1978 | Perry | 124/7 |
| 4,111,179 | 9/1978 | Hashimoto | 124/7 |
| 4,271,813 | 6/1981 | Rowe | 124/7 |
| 4,860,717 | 8/1989 | Powell et al. | 124/7 |
| 4,884,045 | 11/1989 | Powell et al. | 124/7 |

*Primary Examiner*—Theatrice Brown
*Attorney, Agent, or Firm*—Stratton Ballew

[57] ABSTRACT

An inexpensive, uncomplicated ball throwing apparatus to huff balls for hitting and fielding which includes a frame having a front end and a back end supported by a base. The frame has a firing bar hingeably attached to the frame. A pitching armature having a cup end, a hinged mid-point and an elastic band end is coaxially connected to the firing bar at the pivot hinge. A latching mechanism automatically releases the pitching armature at a firing point and includes a latch that attaches the pitching armature to the firing bar. An elastic firing band connects the elastic band end of the pitching armature and the back end of the frame. A latch release cord connects the latch to the front end of the frame and disengages the latching mechanism to release the pitching armature when the firing bar is pulled to a firing point thereby causing the elastic firing band to force the pitching bar to pivot about the pivot hinge. A cup head mounted on the cup end of the pitching armature is designed and mounted to enable the ball to be released from the cup head with backspin. The ball throwing apparatus imparts backspin to the ball each time the machine is actuated, for control and extreme accuracy, causing the ball to assume the flight path desired by the user. The ball throwing apparatus can be easily adjusted to provide a variety of throws and to control the backspin as well.

19 Claims, 9 Drawing Sheets

BALL THROWING APPARATUS AND METHOD

BACKGROUND OF THE INVENTION

The present invention relates generally to an improved ball throwing apparatus and method. More specifically, the present invention relates to an affordable ball throwing apparatus particularly suited for imparting backspin to balls automatically released at a firing point by the apparatus to more closely simulate those balls pitched by humans, particularly junior league pitchers. The ball throwing apparatus insures the flight patterns of pitched balls are consistently accurate.

As a hitter, it is wise to anticipate the pitcher's best pitch. Furthermore, it is a good idea to anticipate at least one type of pitch: the fastball. Reacting to the fastball demands the ultimate in hand-eye coordination. As the fastball approaches home plate, the seams of the baseball are spinning from the bottom upward. With the fastball, the ball is rolling off a pitcher's fingers, causing the ball to spin backward, toward the pitcher. Most pitchers throw their fastballs across the seams, and that is the type of fastball that will tend to rise the most. So if one masters the fastball, every other pitch is slower, be it a slider, curve, screwball, or change-up. If an athlete is geared up to hit a fastball, he or she can easily delay body mechanics quickly enough to react to a slower pitch.

With few exceptions, the most successful pitchers release all of their pitches from the same spot. This is helpful to the hitter because the hitter knows exactly where to look for every pitch. However, the pitcher is also able to effectively camouflage his pitches. Pitchers, especially at lower skill levels, tip their pitches by releasing different pitches from different points. The pitcher's release point is simply the point where the ball leaves his hand. Good pitchers do not vary their release point from pitch to pitch. It is from the release point that one can first begin to read the spin of a pitch.

The prospect, though, of picking out rotation on a baseball thrown from a distance and traveling at a high speed, is difficult. Few ballplayers, particularly at lower skill levels, know what to look for. They do not know how a certain pitch rotates when thrown across the seams, or how a curve or slider spins.

Reading the spin is, therefore, a delicate science. With repeated practice, one can begin reacting more quickly and reflexively. This, in turn, enables a person to more quickly calculate in their mind, how and when to swing. With repetitious hitting practice, one can minimize or completely eliminate chasing pitches out of the strike zone.

With all these possibilities in mind, the ball throwing apparatus of the present invention imparts backspin to the balls hurled from the pitching cup head, resulting in a ball pitched with greater control and stabilized trajectory. This enables one to practice hitting repetitive pitches, mastering the backspin of the most common pitches. Other ball machines available today, fail to pitch a ball having backspin. Therefore, until the present invention, repetitious hitting of fastballs, change-ups, and balls with backspin from a ball throwing apparatus was simply not possible.

There are many existing examples of ball pitching machines and the like. While all these mechanized or manual devices are generally adapted to pitch high and low velocity balls, fly and ground balls, and even curve balls, the greatest drawback to these conventional ball throwing machines is that they fail to impart backspin to the pitched ball. Further, these devices fail to consistently pitch accurate balls due to the orientation of the ball to the receptacle releasing the ball.

For example, U.S. Pat. No. 3,892,217 to Raty describes a pitching machine that is designed specifically to be incapable of being left in a cocked position prior to firing the ball from the throwing arm. In the '217 patent, the ball is cradled or cupped in a "carrying means". The carrying means provides a cradle for a ball in a rest position and an outer end adapted to restrain rear and upper surfaces of the ball. When the ball is forced from the cradle under centrifugal force, there is no backspin imparted.

The U.S. Pat. No. 4,844,045 to Powell, et al. discloses a ball throwing machine having a cocking handle attached to a throwing arm. When the cocking handle is manually released, the arm pulls forward and throws a ball. Furthermore, due to the shape of the hand, the ball throwing device described in the '045 patent imparts little, if any, backspin to the released ball.

The U.S. Pat. No. 4,860,717 to Powell, et al. describes a self-loading, remotely operable and variable portable ball throwing apparatus similar to Powell, et al. '045 and a method. A cocking handle is attached to a throwing arm so that when the cocking handle is manually released, the arm pulls forward and throws a ball. The disadvantages associated with the device of the '717 patent are as follows: the device is not one piece, self-contained and therefore requires assembly in a field prior to each use; the device lacks an automatic and preset release of the pitching arm; and the device does not impart spin or pitch balls accurately every pitch.

The spring type ball-pitching apparatus described in the U.S. Pat. No. 4,082,076 to Perry is a manually operated throwing device having a limited ability, if any at all, to adjust the pitch up or down in the batter's box. The device is difficult to assemble and position correctly. Further, due to the devices complicated nature, it is very difficult to make adjustments for speeds of pitches. Finally, Perry fails to disclose a mechanism for cocking and firing the throwing arm from a firing point in a single stroke by the operator or a means for imparting backspin to the released ball.

The U.S. Pat. No. 4,271,813 to Rowe discloses a simple manually operated baseball pitching machine designed to pitch plastic balls as opposed to heavier balls. Therefore, the device is unable to effectively pitch softballs and baseballs. Due to its light weight torsion coil spring at the base of its pitching arm, the '813 device is unable to provide backspin, consistency and power.

The device disclosed in U.S. Pat. No. 2,080,958 to Beasley, et al. is a manual throwing device which holds a ball in a wire loop and releases a ball by knocking it out of the wire loop upon impact. The '958 utilizes a resilient band to propel a simple ball throwing arm pivoted at the base of the arm. Thus, the '958 patent does not provide a counter pivoting attachment for a resilient band. Although the released ball from the '958 patent may be caused to curve, backspin does not result.

The mechanical ball throwing device of U.S. Pat. No. 3,722,494 to Slevin is a spring loaded pitching arm that is cocked by pulling back on a cocking arm. The cocking arm is manually released, throwing a ball in a desired trajectory. The '494 patent does not include a feature that automatically releases the pitching arm at a firing point. Further, the drag of the lever arms' elongated head and lack of backspin decreases efficiency and accuracy of the released ball.

While more sophisiticated, expensive conventional devices are capable of imparting backspin to the balls thrown, simple mechanical pitching devices such as those mentioned above are limited or incapable of imparting backspin and thus control and accuracy to the balls thrown. Further, these devices have no simple adjustment of height pitch control within the reach of the operator, while being inexpensive and uncomplicated in construction. Additionally, besides being costly and impractical for "junior leaguers" to use for backyard practice, commercial batting machines typically pitch balls too fast for lower level players. However, if the speed is reduced, pitches from commercial batting machines do not simulate junior league pitching.

The orientation of the ball to the receptacle or cup for releasing the ball gives rise to two important conditions: accuracy and backspin. Conventional ball throwing devices fail to orient the ball to the receptacle for optimum accuracy and backspin.

Accordingly, a need exists for an inexpensive, simply constructed improved ball throwing apparatus providing consistently accurate pitches having backspin.

SUMMARY OF THE INVENTION

The present invention provides an improved ball throwing apparatus and method for imparting backspin to a ball thrown by the apparatus. The ball throwing apparatus includes a cup head located on a pitching armature for providing backspin to the ball released out of the cup head.

To this end, in an embodiment, of the present invention provides a frame having a front end, a back end and a supportive base. A firing bar is hingeably attached to the frame and has a pivot hinge. A pitching armature having a cup end and an elastic band end is coaxially connected to the firing bar at the pivot hinge. A cup head is mounted on the cup end of the pitching armature. An elastic firing band is provided that connects the elastic band end of the pitching armature to the back end of the frame. A latching mechanism for automatically releasing the pitching armature at a firing point. The latching mechanism includes a latch that releasably attaches the pitching armature to the firing bar. A latch release cord connects the latch to the front end of the frame. The latch release cord disengages the latching mechanism to release the pitching armature when the firing bar is pulled to a firing point, thereby causing the elastic firing band to force the pitching bar to pivot about the pivot hinge.

In an embodiment, the ball throwing apparatus includes a suppression means for suppressing forward motion of the pitching armature. The suppression means has a first end and a second end. The first end of the suppression means is attached to the base of the frame and the second end is attached to the firing bar.

In an embodiment, a cup head adjusting means for adjusting arc, direction, backspin and speed of the ball released from the cup head.

The invention also provides a method for throwing a ball comprising the steps of: constructing a frame having a front end, a back end and a supportive base; coaxially connecting a pitching armature having a cup end, a pivot hinge and an elastic band end to a firing bar hingeably attached to the frame at the pivot hinge, the pivot hinge located at an intermediate point between the front end and the back end of the frame; providing a latching mechanism that includes a latch, the latch releasably attaches the pitching armature to the firing bar; attaching a latch release cord between the latch and the front end of the frame; mounting a cup head on the cup end of the pitching armature; placing the ball in the cup head; pulling back the firing bar to a firing point; and releasing the firing bar at the firing point which causes the latch release cord to disengage the pitching armature from the firing bar thus hurling the ball forward from the cup head.

It is, therefore, an advantage of the present invention to provide an improved apparatus and method for throwing a ball.

Another advantage of the present invention is to provide an improved method for throwing a ball.

A further advantage of the present invention is to enable the average "little leaguer" to practice at home.

Another advantage of the present invention is to provide consistently realistic, accurate and hittable balls for ball players of all ages, particularly the young ball player.

A still further advantage of the present invention is to provide versatility in that a large variety of ball pitches for individual needs are possible including slow, fast, high arc, no arc, or a combination, straight, curves, drops, fly balls, and ground pitches.

Another advantage of the present invention is to provide an improved ball throwing apparatus for use with a variety of balls, including, but not limited to softballs, baseballs and tennis balls.

A further advantage of the present invention is to provide a ball throwing apparatus capable of a high degree of accuracy, thus pitching a high degree of strikes.

Another advantage of the present invention is to provide a machine that can easily and quickly be adjusted for arc, distance and speed.

Still another advantage of the present invention is to provide a ball throwing apparatus that can easily be placed in a collapsed position and hung on a wall for convenient storage.

Another advantage of the present invention is to provide a self-contained device that does not require assembly on the field.

A further advantage of the present invention is to provide an apparatus requiring only a single mechanical apparatus adjustment of height pitch control within the reach of the operator of the apparatus to provide a variety of throws.

Another advantage of the present invention is to provide a machine where the loading of the pitching cup is very convenient and uncomplicated for the operator.

Another advantage of the present invention is to provide a machine designed for rapid assembly.

A further advantage of the present invention is to provide an improved machine having simplified ball control and stabilized trajectory.

Another advantage of the present invention is to provide a machine which has rapid throwing action due to the efficient travel of the throwing arm combined with quick stopping action.

Another advantage of the present invention is to provide a machine for use in hurling a ball for both batting and fielding practices.

Another advantage of the present invention is to provide a one-piece, self-contained, light weight, portable machine that can be collapsed, lifted and moved by only one person enabling batting practice to be easily held indoors or outdoors.

Another advantage is that it provides a pitching substitute for a "coach pitcher".

A further advantage of the present invention is to provide a machine for exercise and for developing the skills and reflexes required to become a proficient ball hitter and fielder.

Additional features and advantages of the present invention are described in and will be apparent from the detailed description of the presently preferred embodiments and from the drawings.

DETAILED DESCRIPTION OF THE PRESENTLY PREFERRED EMBODIMENTS

Figure 1:
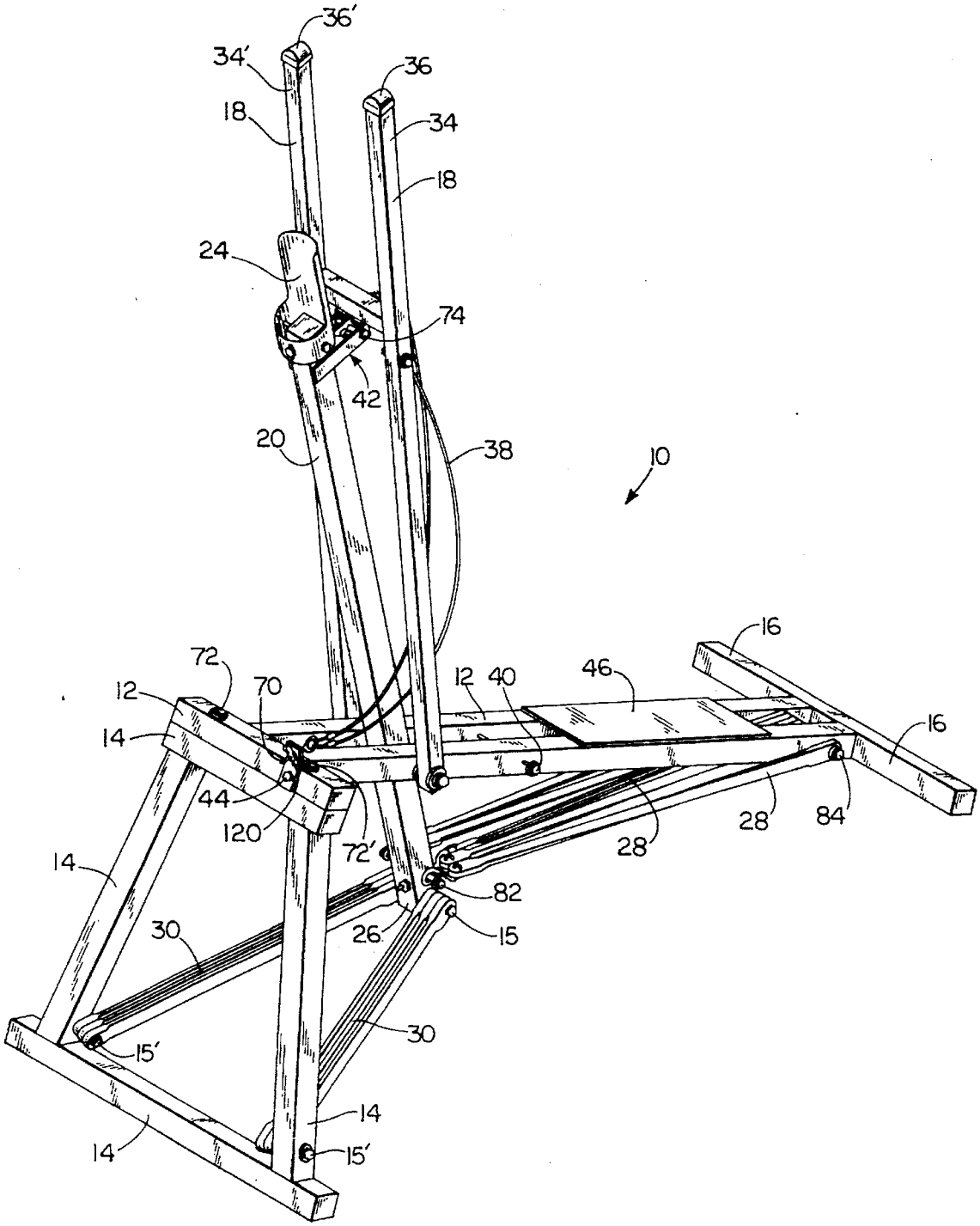
FIG. 1 is a perspective view of the ball throwing apparatus.
Figure 2:
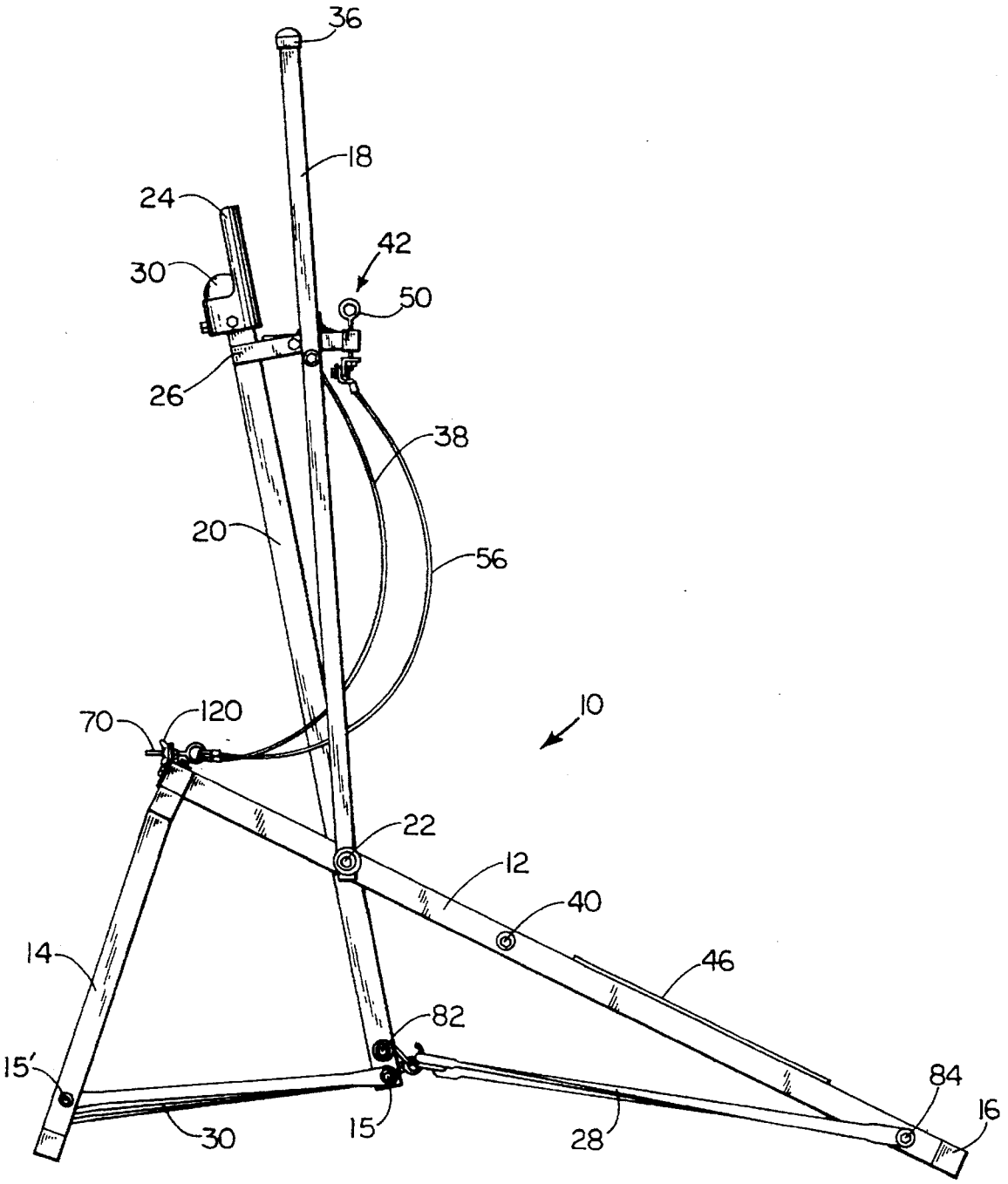
FIG. 2 is a side view of the ball throwing apparatus in the uncocked, rest position.

The preferred embodiment of the present invention is illustrated by way of example in FIGS. 1–9. With specific reference to FIGS. 1–6, a ball throwing apparatus 10 includes a frame 12 having a front base 14 and a rear base 16. The frame supports a firing bar 18 that is attached at a pivot hinge 22 located at an intermediate point between the front base and the rear base of the ball throwing apparatus. A pitching armature 20 is coaxially connected to the firing bar at the pivot hinge 22.

The frame 12 is attached to the front base 14 with bolts 72 and 72'. The rear base 16 can include rear stakes (not shown) by which the apparatus 10 can be bolted upon plywood or staked temporarily or permanently to the ground to prevent the apparatus from moving during a pitching session. The frame includes a step plate 46 to provide a convenient place for the operator (not shown) to step upon while operating the apparatus 10.

A bubble level (not shown) can be mounted on the frame 12 to assist the operator of the apparatus in determining whether the apparatus is situated on level ground. The bubble would also allow the field operator to match the setting previously used. Similarly, a compass (not shown) could be mounted on the frame to more accurately assess the direction of the pitch during a pitching session.

The pitching armature 20 has a cup head 24 for receiving a ball 80 (see FIGS. 2 and 5), the pivot hinge 22 and an elastic band end 26. In addition to being coaxially connected to the firing bar at the pivot hinge, the pitching armature attaches to the firing bar 18 by a latching mechanism 42, located below the cup head. A plurality of firing bands, collectively referred to as 28, connect to the elastic band end of the pitching armature at a band holder bolt 82 and the rear base 16 of the ball throwing apparatus at a rear band bolt 84. Firing band tension can be varied by connecting alternative numbers of firing bands or firing bands of differing elasticity and tension, thus correspondingly changing the pitching speed. A storage bolt 40 is located approximately midway on the frame for holding the firing bands during storage of the ball throwing apparatus. The step plate 46 also partially covers the firing bands.

A set of recoil bands 30 connect the elastic band end 26 of the pitching armature 20 to the front base 14. In an embodiment, six recoil bands are used. The recoil bands are attached to the pitching armature using a first bolt 15 and to the front base using a second bolt 15'. Although bolts are shown in the illustrations, other means of attachment are also contemplated. The set of recoil bands 30 act as shock absorbers, halting the pitching armature 20 at the end of the pitching swing. Additionally, the set of recoil bands reduce vibration of the ball throwing apparatus 10 during the pitch. The recoil bands function to suppress forward motion of the pitching armature. The firing band 28 and the set of recoil bands 30 and 30' are preferably constructed from elastic. Elastic cords, springs and other similar means function satisfactorily.

The firing bar 18 has a hinged end 32 and a pair of handle ends 34 and 34'. The firing bar is hingeably attached to the frame 12. A single handle (not shown) is envisioned as well. A pair of caps 36 and 36' are attached at the handle ends 34 and 34' to provide protection to the operator from any rough or sharp edges. The firing bar also has a power cord 38 which is attached at one end to a latching mechanism 42 and at another end to a bracket 44 located on the frame, which enables operator selectable retraction of the firing bar.

Figure 3:
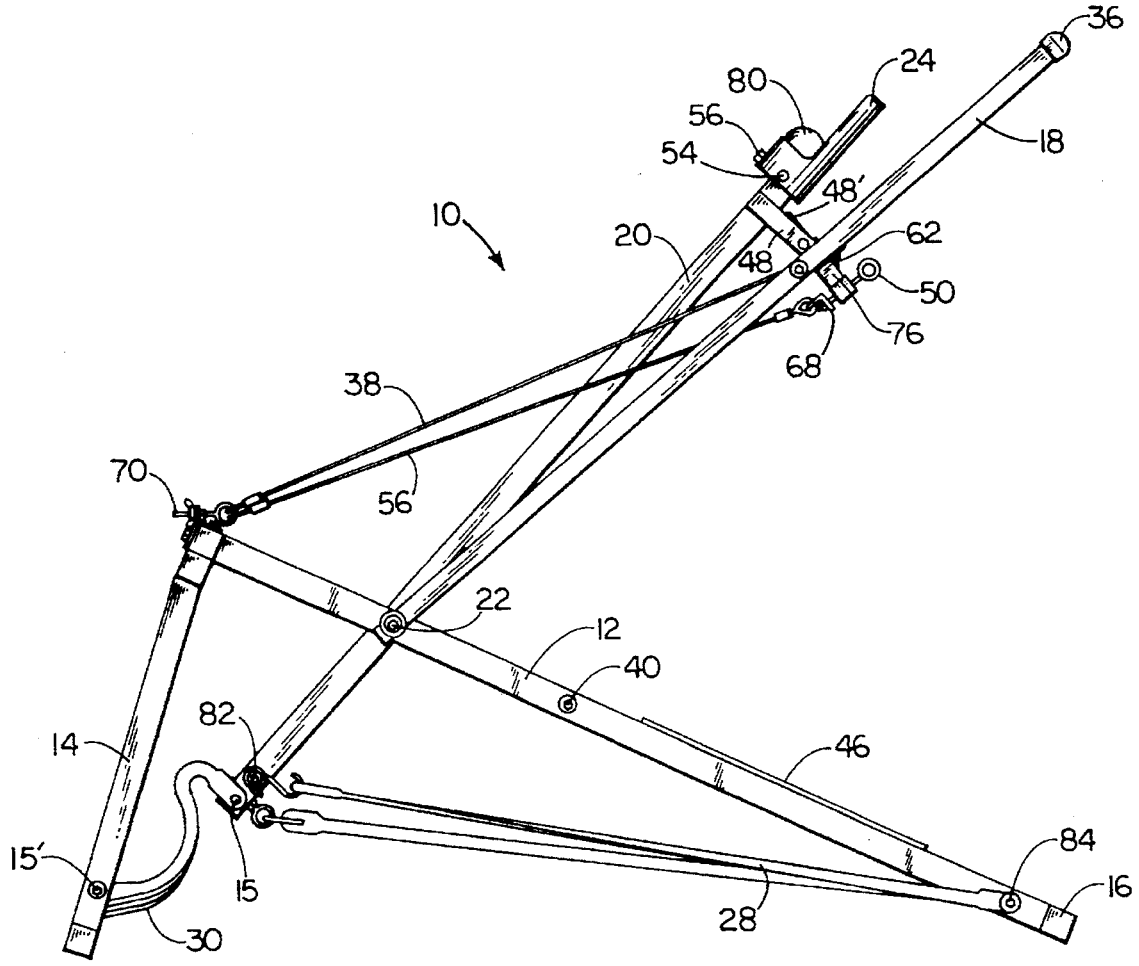
FIG. 3 is a side view of the ball throwing apparatus in the cocked position.
Figure 4:
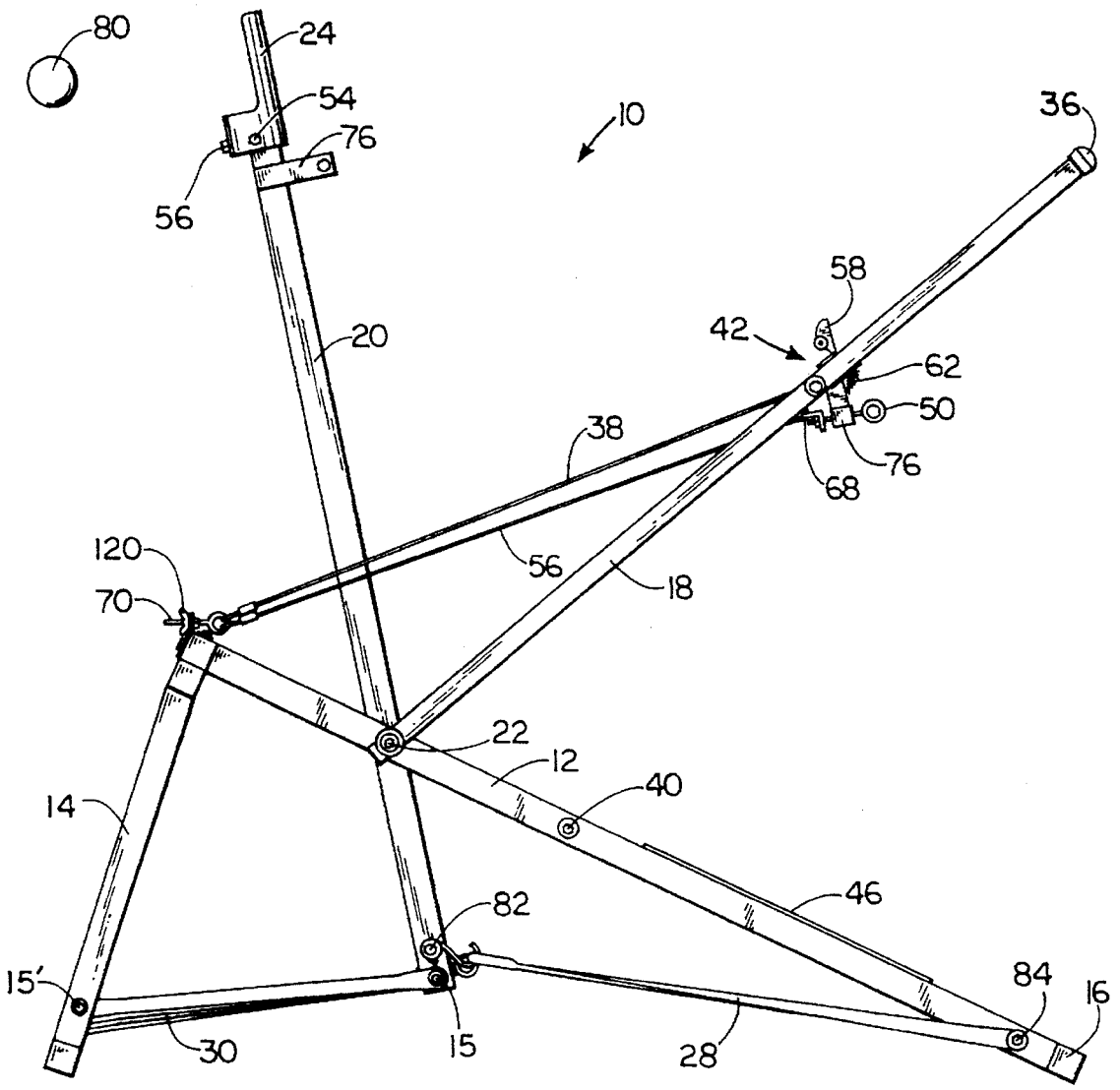
FIG. 4 is a side view of the ball throwing apparatus after the release of the ball from the cup head.
Figure 5:
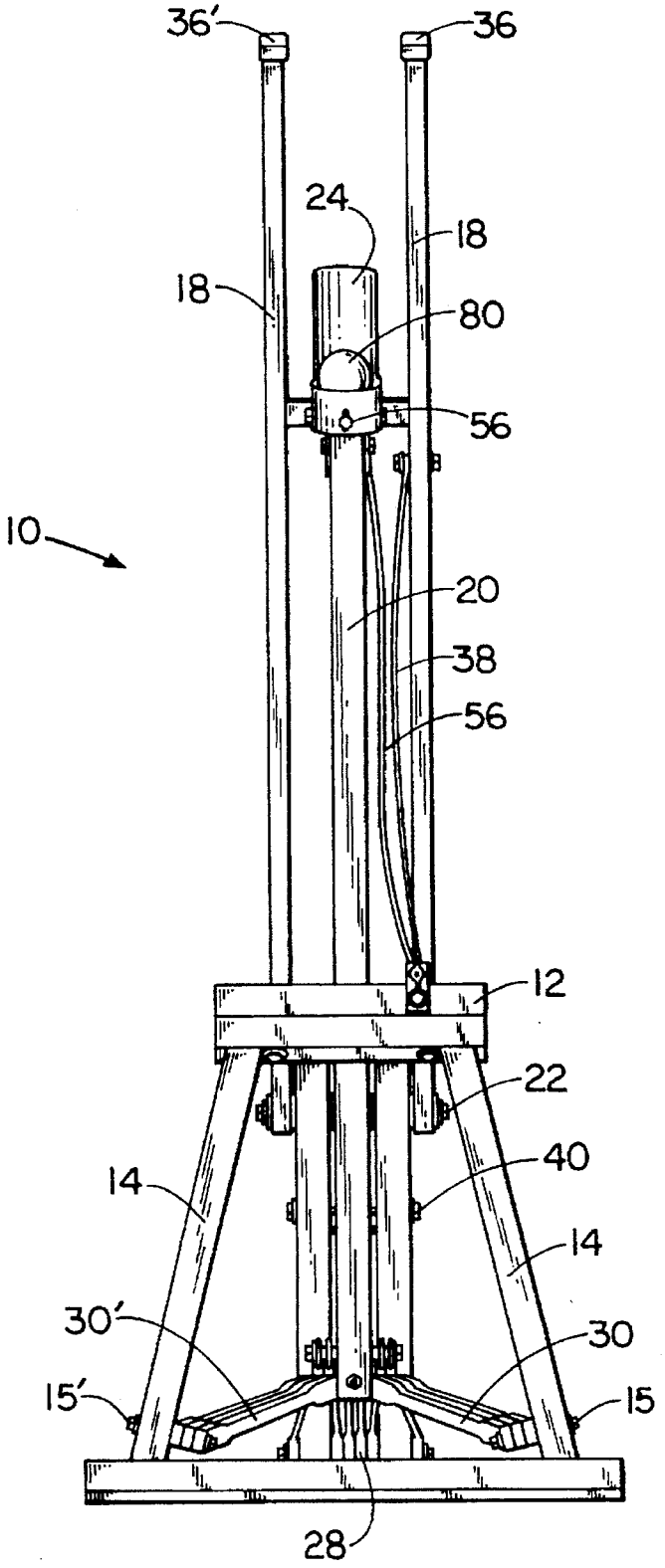
FIG. 5 is a front view of the ball throwing apparatus.
Figure 6:
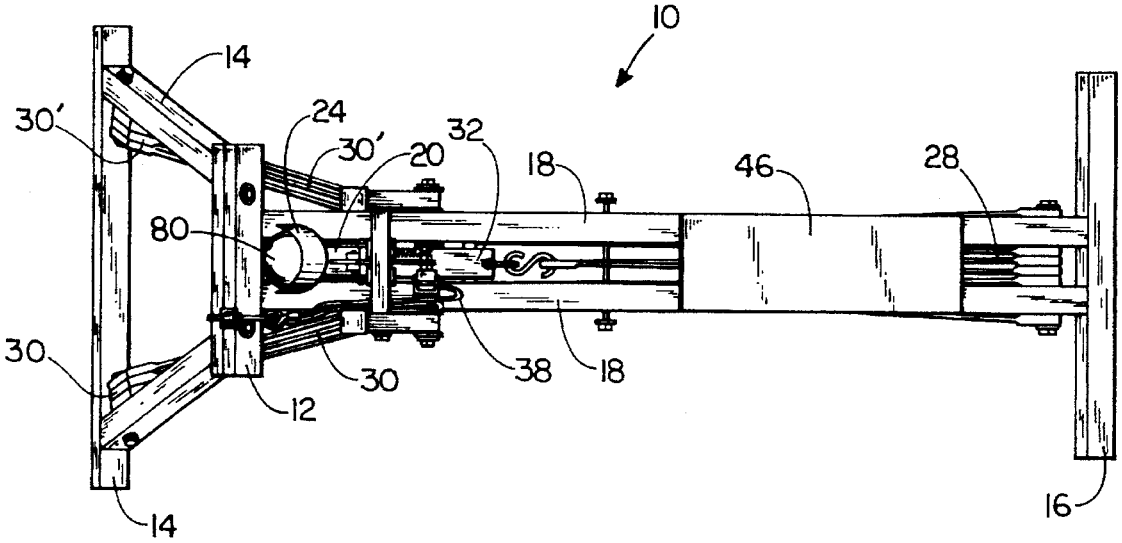
FIG. 6 is a plan view of the ball throwing apparatus.

Additionally, the firing bar 18 includes a feature that allows for the automatic release of the pitching armature 20 at a firing point, as shown in FIGS. 3 and 4 when the power cord 38 and a latch release cord 56 are taut. This feature of automatic and preset release of the pitching armature allows the operator to cock and fire the pitching armature from a firing point in a single stroke or motion. The firing bar is actuated by the operator or alternatively by an automatic pulling means (not shown) to pull the firing bar to the firing point.

An adjustable release pin 70, as shown in FIG. 1, is attached to the frame 12. The adjustable release pin holds the latch release cord 56 and power cord 38, thus limiting the travel of the firing bar 18 in the direction of the rear base 16.

Figure 7A:
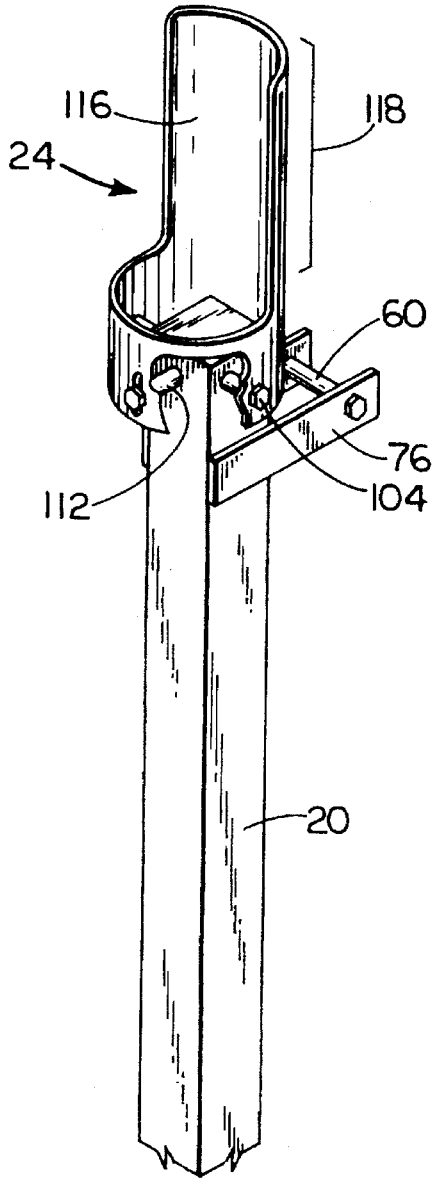
FIG. 7A is a perspective view of a cup head attached to a pitching armature.
Figure 7B:
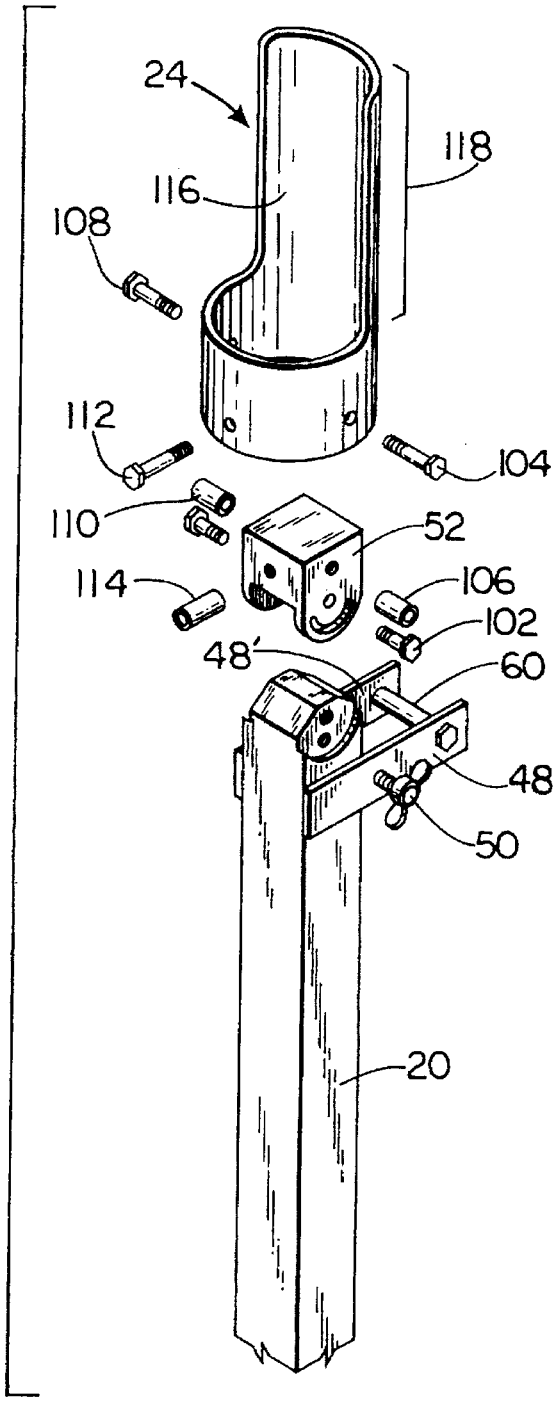
FIG. 7B is an exploded view of a cup head and a pivotal assembly.
Figure 8:
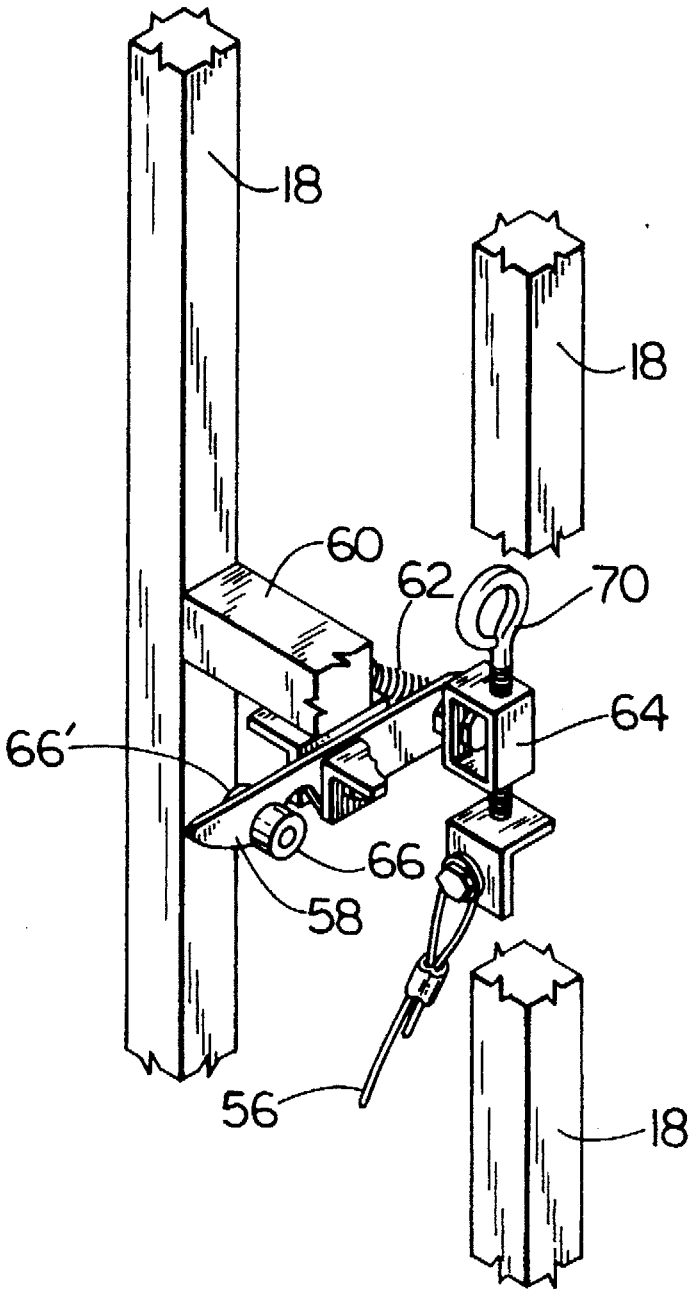
FIG. 8 is a partially sectioned detail of the locking mechanism.
Figure 9:
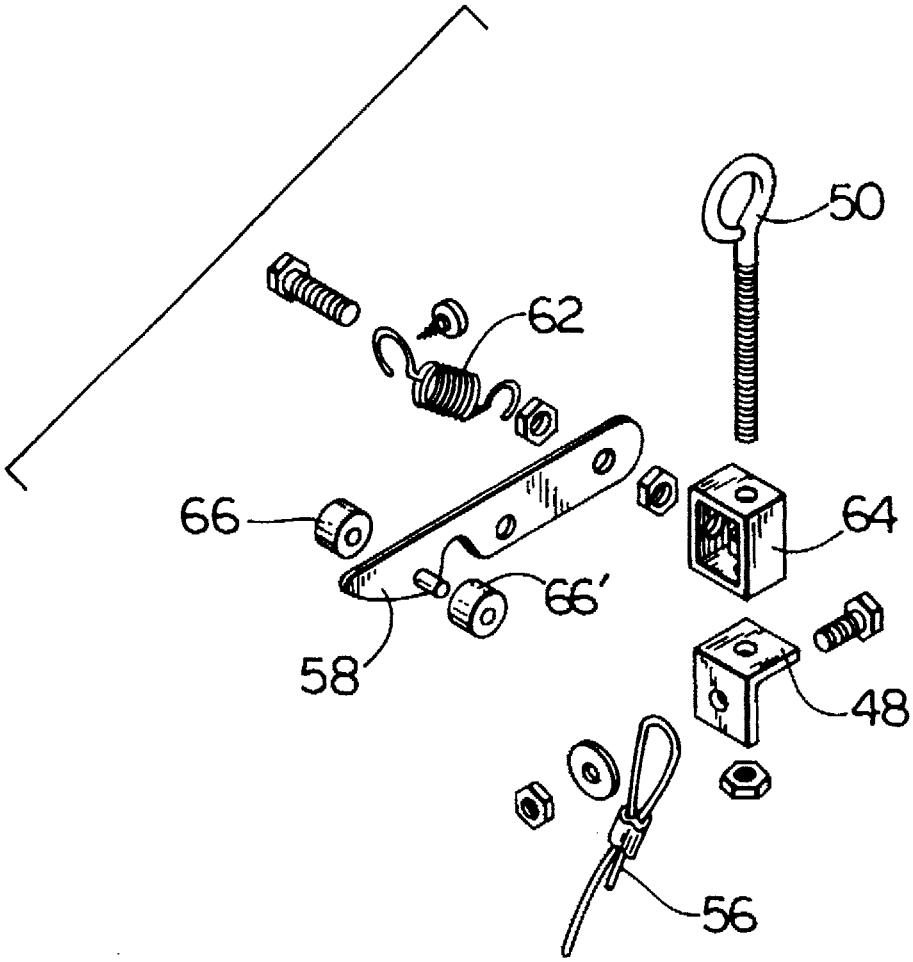
FIG. 9 is an exploded view of a latch and an adjusting connector.

As shown in FIG. 1, the pitching armature 20 includes the latching mechanism 42. As shown in FIGS. 7A, 7B and 8, the latching mechanism includes a latch 58, a lever crossbar 60, a latch spring 62, an adjusting connector 64 and a bracket 68 for the latch release cord 56. The latching mechanism includes two roller bearings 66 and 66', used to engage a trigger latch 58. Additionally, the latching mechanism includes two brackets 48 and 48' and a pivot bolt 74.

Two brackets 48 and 48' are located on the pitching armature 20. The two brackets attach the latching mechanism to the pitching armature. An adjustment screw 50 is located on a catch bracket 76, as shown in FIG. 7B to allow the operator to make adjustments to vary the pitch. The adjustment screw is preferably a swivel bolt for easy gripping and turning. A pivotal assembly 52, as shown in FIG. 7B, is included on the pitching armature under the cup head 24. The pivotal assembly includes a main bolt 102, a first side bolt 104, a first bushing 106, a second bolt 108, a second bushing 110, a front bolt 112, and a front bushing 114 to enable "tilt adjustment" of the cup head.

The cup head 24 is attached to the pitching armature 20. Cup heads of various sizes (not shown) can be interchanged for one another depending on the type of ball desired to be hurled. For instance, the cup head used for baseballs can be easily removed to allow a larger cup head (not shown) that can be used with softballs.

The cup head 24 includes two side pivot bolts 104 and 108 and front bolt 112 as shown in FIGS. 7A and 7B. The front bolt functions to provide tilt adjustment of the cup head. The cup head can also include an abrasive surface 116 as shown in FIG. 7A to increase the backspin imparted by the cup head.

The cup head 24 provides backspin to a ball 80. The cup head is designed to delicately balance and support a ball with proper clearance so that the ball is held in a low or friction free state. As the pitching arm is released under power, inertia forces the ball against the smooth, contoured surface of the cup head. As speed and inertia increase, the ball rolls along an elongated portion 118 of the cup head. Thus, the ball is released out of the cup head with a backspin. Tilting the cup head from front to back by adjusting the front bolt 112 and the side bolts 104 and 110 affects the backspinning ball's arc and direction to the target or "strike zone".

Therefore, tilting the cup head will control the backspin in addition to establishment of the arc or lack of arc of the pitched ball's flight pattern. Gauged markings (not shown) on the cup head indicate the best settings to use for arc and backspin of various throws and distances. Once the ball throwing apparatus is fine tuned to the pitch desired, field adjustments are seldom required. When an operator (not shown) of the ball throwing apparatus 10 pulls the firing bar 18 to a firing point as shown in FIG. 3, at which moment the latch 58 releases the pitching armature 20, a ball resting in the cup head 24 is catapulted forward as shown in FIG. 4.

The latch 58 is preset to release at the same point on every pitch because a latch release cord 56 connects the latch to the front base 14 of the frame 12. When the firing bar 18 is pulled to the firing point, the latch release cord 56 disengages the pitching armature 20 from the firing bar. The firing band 28 forces the pitching armature 20 to immediately pivot about the pivot hinge 22 of the ball throwing apparatus 10.

The ball throwing apparatus 10 does not require any electricity to operate, however, electrically firing embodiments are also envisioned. The ball throwing apparatus can be constructed from a variety of materials including, but not limited to, wood, metal and plastic.

After the ball throwing apparatus 10 is assembled, the operator determines what type of ball they would like to have pitched. For example, the operator will consider the pitch, distance and average speed. Next, the firing bar 18 and the latching mechanism 42 are attached to the front base 14 of the frame 12. The adjustment nuts (not shown) are preferably set to a midpoint position on the adjustment release pin 70. The cup head 24 is tilted about five degrees toward the front base 14.

All bolts should be secured and all of the firing bands 28 are attached. Next, the level condition is checked for side to side and front to back. If the apparatus is not level, the result will be more friction caused by the ball 80 on the side of the cup head which in turn will affect the pitch. If the apparatus is not level from front to back, this may lower or raise the ball in the strike zone.

The operator (not shown) of the ball throwing apparatus 10 can opt to change the path of pitches to the left or fight simply by using left or right pressure on the firing bar 18 when pulling the firing bar back. This side pressure is transformed to the pitching armature 20 causing the flight pattern of the ball to vary from the normal straight pitch. It is preferred that one try several pitches and fine tune adjustments as needed.

The latch release cord 56 is factory set for normal pull back of the firing bar 18 when an adjustment nut 120 is set at mid-point on the adjustment release pin 70 as shown in FIGS. 1 and 4. Movement of the adjustment nut setting will raise or lower the height of the pitch at the same time slightly increasing or decreasing ball speed.

The ball throwing apparatus 10 of the present invention can also be used by nonpitchers to develop lower level catching skills such as fielding ground balls and catching fly balls. For instance, it may be used to develop catching skills by pitching grounders and low pitches, or fly balls and high pitches.

Although in the preferred embodiment the machine is designed for softball and baseball applications, it should be appreciated that the machine can be used for a variety of applications, other sports such as tennis, and catapulting various objects.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A ball throwing apparatus for throwing a ball comprising:

a frame having a front end, a back end, and a supportive base;

a firing bar, hingeably attached to the frame, the firing bar having a pivot hinge;

a pitching armature having a cup end and an elastic band end is coaxially connected to the firing bar at the pivot hinge;

a cup head mounted on the cup end of the pitching armature;

an elastic firing band that connects the elastic band end of the pitching armature to the back end of the frame;

a latching mechanism for automatically releasing the pitching armature at a firing point, the latching mechanism including a latch that releasably attaches the pitching armature to the firing bar; and a latch release cord connecting the latch to the front end of the frame, the latch release cord for disengaging the latching mechanism to release the pitching armature when the firing bar is pulled to a firing point, thereby causing the elastic firing band to force the pitching bar to pivot about the pivot hinge.

2. The ball throwing apparatus of claim 1 further comprising a cup head adjusting means for adjusting arc, distance, backspin and speed of the thrown ball.

3. The ball throwing apparatus of claim 1 further comprising a suppression means for suppressing forward motion of the pitching armature, the suppression means having a first end and a second end, the first end being attached to the base of the frame and the second end being attached to the firing bar.

4. The ball throwing apparatus of claim 1 further comprising a plurality of elastic recoil bands connecting the elastic band end of the pitching armature and the front end of the frame.

5. The ball throwing apparatus of claim 1 wherein the cup head is removable and sized to accommodate balls of differing sizes.

6. The ball throwing apparatus of claim 1 wherein the cup head includes an elongated portion.

7. The ball throwing apparatus of claim 1 wherein the cup head includes a frictional surface.

8. The ball throwing apparatus of claim 1 wherein the cup head includes a low friction surface.

9. The ball throwing apparatus of claim 1 further comprising a plurality of elastic firing bands connecting the elastic band end of the pitching armature to the back end of the frame.

10. The apparatus of claim 1 wherein the supportive base includes a stake allowing the ball throwing apparatus to be anchored to the ground.

11. The apparatus of claim 1 wherein the cup head includes an elongated portion to enable the ball to be released from the cup head with backspin.

12. A method for throwing a ball comprising the steps of:

constructing a frame having a front end, a back end and a supportive base;

coaxially connecting a pitching armature having a cup end, a pivot hinge and an elastic band end to a firing bar, the firing bar hingeably attached to the frame at the pivot hinge, the pivot hinge located at an intermediate point between the front end and the back end of the frame;

providing a latching mechanism that includes a latch, the latch releasably attaches the pitching armature to the firing bar;

attaching a latch release cord between the latch and the front end of the frame;

mounting a cup head on the cup end of the pitching armature;

placing the ball in the cup head;

pulling back the firing bar to a firing point; and releasing the firing bar at the firing point which causes the latch release cord to disengage the pitching armature from the firing bar thus hurling the ball forward from the cup head.

13. The method of claim 12 further comprising the step of adjusting the cup head to determine the arc, distance, and backspin of the ball to be thrown.

14. The method of claim 12 further comprising the step of providing the cup head with a frictional surface and imparting backspin to the ball after release from the cup head.

15. The method of claim 12 further comprising the step of suppressing forward motion of the pitching armature with a recoil band having a first end and a second end, the first end being attached to the base of the frame and the second end being attached to the firing bar.

16. A ball throwing apparatus for hitting and fielding a ball, the apparatus comprising:

a frame having a front end, a back end, and a supportive base;

a firing bar, hingeably attached to the frame, the firing bar having a pivot hinge;

a pitching armature coaxially connected to the firing bar at the pivot hinge, the pitching armature having a cup end and an elastic band end;

a cup head mounted on the cup end of the pitching armature, the cup head having an elongated portion;

a cup head adjusting means for adjusting arc, distance, backspin and speed of the thrown ball;

an elastic firing band that connects the elastic band end of the pitching armature to the back end of the frame;

a latching mechanism including a latch that releasably attaches the pitching armature to the firing bar, the latching mechanism automatically releasing the pitching armature at a firing point;

a latch release cord connecting the latch to the front end of the frame, the latch release cord disengaging the latching mechanism to release the pitching armature when the firing bar is pulled to a firing point, thereby causing the elastic firing band to force the pitching bar to pivot about the pivot hinge; and a suppression means for suppressing forward motion of the pitching arm, the suppression means having a first end and a second end, the first end being attached to the base of the frame and the second end being attached to the firing bar.

17. The ball throwing apparatus of claim 16 wherein the cup head is removable and sized to accommodate various shaped balls.

18. The ball throwing apparatus of claim 17 wherein the cup head includes a frictional surface.

19. The ball throwing apparatus of claim 17 wherein the cup head includes a low friction surface.

* * * * *